United States Patent [19]

Dobrusskin et al.

[11] Patent Number: 4,739,220

[45] Date of Patent: Apr. 19, 1988

[54] METHOD OF MAKING A SINGLE-BASED METAL HALIDE HIGH-PRESSURE DISCHARGE LAMP, AND LAMP MADE ACCORDING TO THE METHOD

[75] Inventors: Alexander Dobrusskin, Taufkirchen; Jürgen Heider; Achim Gosslar, both of Munich, all of Fed. Rep. of Germany

[73] Assignee: Patent-Treuhand-Gesellschaft fur electrische Gluhlampen mbH, Munich, Fed. Rep. of Germany

[21] Appl. No.: 915,714

[22] Filed: Oct. 6, 1986

[30] Foreign Application Priority Data

Oct. 24, 1985 [DE] Fed. Rep. of Germany ..... 3537878

[51] Int. Cl.[4] ..... H01J 5/38

[52] U.S. Cl. ..... 313/623; 445/26; 313/318; 313/332

[58] Field of Search ..... 445/26, 27, 22, 39; 313/318, 332, 623

[56] References Cited

U.S. PATENT DOCUMENTS 3,617,797 11/1971 Emmasingel et al. ..... 313/318
4,542,316 9/1985 Hall et al. ..... 313/623
4,668,204 5/1987 English et al. ..... 445/26

FOREIGN PATENT DOCUMENTS 47-308 1/1972 Japan .
1442497 7/1976 United Kingdom .

*Primary Examiner*—Kenneth J. Ramsey
*Attorney, Agent, or Firm*—Frishauf, Holtz, Goodman & Woodward

[57] ABSTRACT

To increase the high-voltage resistance of a metal halide high-pressure discharge lamp, the external leads (6, 6', 6'') are spaced wider apart than previously at their exit point from a pinch seal (3', 23', 23''). To facilitate manufacture, and to permit the widened spacing of the electrodes, the lamp portion (3) which will form the pinch seal is pre-heated in a first step and deformed into elongated oval cross section, leaving enough space to introduce a subassembly formed of the electrode connecting leads (6), internal electrodes (7) and molybdenum sealing foils (9); the sealing foils (9) may then already be located with a spacing which is increased with respect to spacing usually customary in the prior art. The external connecting leads (6) are secured to the sealing foils (9) so that attachment points extend at right angle to the sealing foils; the attachment leads can be angled within the press seal (FIG. 1*e*) or the angled portions of the connecting leads (6') can extend through lateral slits formed in the press seal outside of the lamp, to be then angled off (FIG. 2*b*) or to extend laterally (FIG. 2*c*) from the pinch or press seal (3', 23', 23'').

11 Claims, 1 Drawing Sheet

Fig. 1a
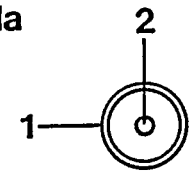
Fig. 1b
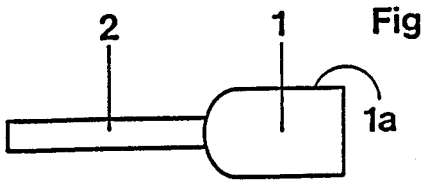
Fig. 1c
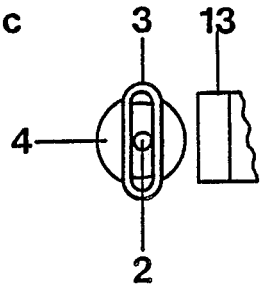
Fig. 1d
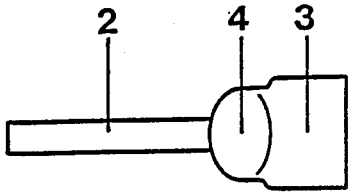
Fig. 1e
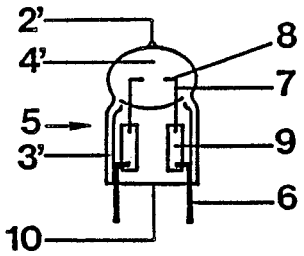
Fig. 2a
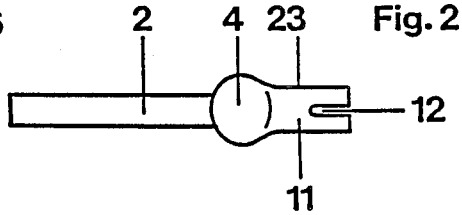
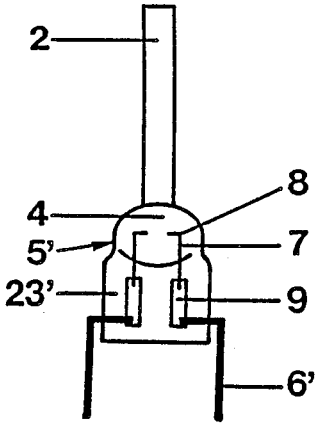
Fig. 2b
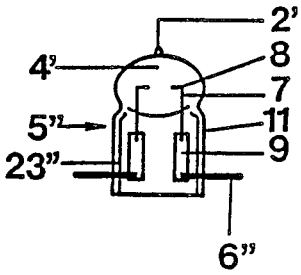
Fig. 2c

METHOD OF MAKING A SINGLE-BASED METAL HALIDE HIGH-PRESSURE DISCHARGE LAMP, AND LAMP MADE ACCORDING TO THE METHOD

The present invention relates to metal halide or halogen high-pressure discharge lamps, and to a method of making the lamps, in which the lamps are single-ended or single-based and lamp current leads are carried out from a press or pinch seal.

Background

Many metal halide discharge lamps are formed in a single-ended or single-based construction, in which a discharge vessel, typically of quartz glass, is provided, through which lead connections are carried; the discharge vessel is sealed by a pinch or press seal. To permit sealing the discharge connection through the pinch seal, external connecting wires or pins are secured to molybdenum metal foils which, in turn, are connected to the electrodes within the lamp. The pinch seal or press seal is formed in the region of the molybdenum foils, surrounding also the immediately adjacent portions of the connecting wires. The molybdenum foils extend parallel to each other, within the glass, and are located in a plane within the pinch or press seal, to be retained flat therein. In accordance with customary production techniques, the pinch seal is made in this manner:

(1) A circular cylindrical glass tube or cane is provided which, later on, will form the discharge vessel; an exhaust and fill gas supply and pump tube is connected thereto;

(2) a portion of the glass tubing, somewhat below the attachment of the pump tube, is heated to a temperature sufficient so that the glass of the tubing becomes plastically deformable;

(3) a subassembly of the electrode system, which includes the external current supply leads, the sealing foils, and the electrodes to be located within the discharge vessel, are introduced into the region of the glass tube which has been heated to plastically deformable temperature from the end remote from the pump tube; heating can also be done only after introducing the electrode system while holding it in a suitable holder;

(4) pinch jaws are then moved from diametrically opposite sides of the tubing towards the heated region of the tubing, the jaws being shaped to form dies or molds for the pinch seal to be made; the width of the pinch seal will be approximately the same as the diameter of the cylindrical tubing of the discharge vessel;

(5) the portion of the tube, now sealed at one end with the electrodes introduced, is evacuated and a fill is introduced through the pump tube, and the pump tube is tipped off.

In order to insure that the vessel is tight, that is, tightly sealed, it is customary to utilize sealing foils made of molybdenum in vessels in which the tubing is made of quartz glass. Continuous wire elements passing from the outside of the lamp into the lamp and carrying the lamp electrodes cannot be reliably sealed through quartz glass. The continuous trend towards miniaturization, and the demand for discharge lamps of lower output power, results in smaller sizes of the discharge vessels and, further, smaller sizes of the pinch seal, in which the sealing foils of molybdenum are embedded. Difficulties have arisen to maintain the required distance between the relatively wide sealing foils to be introduced through the pinch seal. These sealing foils are located in a single plane, and the maintenance of the spacing between the facing edges of the sealing foils, within the small and narrow pinch seal, is difficult. The electrodes have to be spaced from each other by some minimum spacing which is determined not by the operating voltage of the lamp but, rather, by the voltage of a voltage pulse which is necessary to cause the lamp to start or ignite. Depending on the temperature state of the lamp, an ignition voltage of at least 6 $kV_p$ must be applied to insure reliable starting.

In order to provide for the necessary insulation of the external current leads, it has previously been proposed to carry the current leads out from the pinch seal at an angle and to insulate the current leads from each other by glass tubes which are filled with a filling material and closed off by an elastic plastic substance (see British Pat. No. 1,442,497). This results in complex manufacturing steps which raise the price of the lamp out of proportion to the remaining manufacturing costs. The quartz insulating tubes which are comparatively long are subject to breakage and, in case they should break, the electrical insulation capability of the electrode leads is substantially impaired.

It has also been proposed to bend the sealing foils within the press seals by about 90° towards the outside, so that the spacing of the external current supply leads is increased—see Japanese Utility Model Publication No. 47-308. Handling the sealing foils of molybdenum—which foils have a thickness of only a few hundredths mm (a few $10^{-5}$ m) thickness is very difficult and unsuitable. Reliability and durability upon passage of current through foils so treated is substantially reduced.

U.S. Pat. No. 3,617,797 describes an arrangement in which the current leads are carried out laterally from the press or pinch seal. This lamp is designed for use in an optical system, and the particular placement of the external connecting leads is arranged to permit the filament to have a predetermined distance from the end of the base; the press seal can be changed in its length subsequently to the original manufacture so that the position of the filament can be matched to the respective optical system.

The Invention

It is an object to provide a method to make the lamp, and a lamp which has a pinch seal which is so made that the necessary width of the sealing foils can be readily accomodated within the pinch seal. The lamp permits application of high voltage to the supply leads, that is, voltage of at least 6 $kV_p$. Manufacture of the press seal, and the introduction of the electrode system, as well as of the electrode system itself is simple so that a sturdy, reliable lamp can be inexpensively manufactured.

Briefly, the method in accordance with the prior art, described above, is so changed that an additional step is carried out prior to forming the pinch seal. In accordance with a feature of the invention, the end of the circular cylindrical tube, previously heated to plastically deformable temperature, is pre-formed or prepressed by a pair of pinch jaws, externally applied towards the circular cylindrical, pre-heated and plastically deformable tube end, to shape the circular cylindrical tube in that region to have a generally oval, elongated cross-sectional shape, the larger diameter of which is greater than the diameter of the circular cylindrical tube. The electrode system is then introduced through this now enlarged, oval opening and then the steps, known in the prior art, of forming the press seal, are carried out in accordance with well known operating methods.

The method, thus, can readily be adapted and used in existing production machinery, and results in press seals which are easily made, while maintaining spacing between the respective electrical components of the lamp.

In accordance with a feature of the invention, the deformed end of the discharge vessel can be formed with slits at the narrow side surfaces. Regardless of the specific method selected, the pinch seal will be widened, which permits an increased spacing between the external current supply leads. Such a widened pinch seal can be made rapidly and inexpensively.

In accordance with a feature of the invention, the external current supply leads are so connected to the parallel sealing foils that the longitudinal axes of the connecting leads form a right angle with respect to the lamp axis, that is, the end portions of the connecting leads are directed inwardly at the point of attachment to the sealing foils. The external current supply leads then can be carried out of the pinch or press seal, as selected or desired, either at the narrow side surfaces of the pinch or in axial direction from the lamp if angled off at the connection points to the sealing foils axially within or without the pinch seal.

DRAWINGS

FIGS. 1*a* and 1*c* are bottom end views of tubing illustrating steps in the manufacture of the lamp;

FIGS. 1*b* and 1*d* are side views corresponding to the bottoms of FIGS. 1*a* and 1*c*, and illustrate steps in the manufacture of the lamp;

FIG. 1*e* is a side view of a step in the manufacture of the lamp;

FIG. 2*a* illustrates a modification of a step in the manufacture of the lamp; and FIGS. 2*b* and 2*c* are side views of two different embodiments of the lamp, in different stages of manufacture.

DETAILED DESCRIPTION

A circular cylindrical quartz tube 1 has a pump tube 2 connected thereto—see FIGS. 1*a*, 1*b*, as is well known in the manufacture of high-pressure discharge lamps in which tubing 1 of quartz glass is being used. In accordance with a feature of the invention, the region 1*a* of the tubing 1—FIG. 1*b*—is preheated to become plastically deformable; the next step is a pre-deformation by moving a pair of jaws 13 from both sides of the lamp to deform the region 1*a* into the shape shown at 3 in FIG. 1*c*. This will, then, already define the region 4 of the discharge vessel and the pinch seal 3' to be formed thereafter. Only one jaw 13 is shown for clarity. It is to be noted that the pre-deformed end zone 1*a*, which previously has been heated, is not closed, but remains open. The diameter of the pre-deformed end 3 will be larger than the original diameter of the tubing 1—see FIG. 1*c*. The remaining portion 4 of the quartz tube 1 will, later on, form the discharge vessel and will retain its circular form.

An assembly including external current leads 6, molybdenum foils 9, and electrodes 7—see FIG. 1*e*—is then introduced through the pre-formed, elongated opening in the region 3. After introducing this electrode system, a second press step is carried out to form the final pinch seal, during which step the width of the pinch seal is reduced to the desired diameter of the circular cylindrical tube 1, e.g. about to the outer diameter of the discharge vessel 4' (FIG. 1*e*). In a final step, the discharge vessel 4' is evacuated and filled with the desired fill and the remaining portion of the pumping tube 2 is tipped off to form the tip 2' remaining on the vessel 4'. The formation of the final pinch seal, evacuating, filling and tipping off can be in accordance with any well known method.

The pre-deformed elongated oval opening, defined by the pre-deformed region 3, has the electrode systems introduced, which include the external current supply lead 6 and an internal electrode 7 made of tungsten, which is pre-bent in the zone within the discharge vessel 4' to have an end portion 8 of the electrode facing the opposite electrode. The shape of the electrodes 7 and the facing ends are shown in the drawings schematically and may be in accordance with any desired construction. Sealing foils 9 of molybdenum connect the external supply leads 6 and the inner electrode leads 7.

In accordance with a feature of the invention, the external supply leads 6 are connected to the sealing foils 9 so that the connecting portions are angled at 90° with respect to the major extent of the sealing foils 9. Typically, the connection of the leads 6 and electrodes 7 to the foils 9 is by welding. As shown in FIG. 1*e*, the welded connections of the connecting leads 6 form a right angle, which will be located within the pinch seal 3', so that the terminal ends of the connecting leads 6 leave the end 10 of the pinch seal 3' in parallel, spaced relationship. This arrangement permits a substantial increase in the spacing between the external current supply leads 6, thus substantially increasing the resistance of the lamp with respect to high voltage, and particularly high-voltage pulses which may occur during starting or initial igniting of the lamp.

Various changes and modifications are possible; for example, the pre-shaped oval opening 3 may be formed with lateral slits 12 (FIG. 2*a*). The first two steps in the method of making the lamp of FIG. 2*a* can be as described in connection with FIGS. 1*a* to 1*d* and, hence, need not be repeated. The difference is that, for example, during or after the pre-pinching step—FIGS. 1*c*, 1*d*—small, additional slits 12 are formed at the narrow side surfaces 11 of the pre-formed oval deformed zone 23. These slits 12, which do not extend up to the final discharge space 4, permit introduction of the electrode systems. These electrode systems may be identical to the systems shown in FIG. 1*e*, with the exception, however, that the provision of the slits 12 permits the external current supply leads to be carried out laterally from the pinch or press seal. FIG. 2*b* illustrates a lamp 5', in which the connecting leads 6' are angled, as the leads 6 in FIG. 1*e*, but extend laterally further out, so that the axially extending portions of the leads 6' will be outside of the outline of the lamp 5'. This additionally increases the high-voltage flash-over resistance of the lamp, and is particularly desirable if the lamp is to be subjected to re-starting or re-ignition while it is still hot. In this embodiment, the pinch seal 23' may extend slightly over, that is, be somewhat wider than the original circular diameter of the lamp, and hence of the discharge vessel 4 (see FIG. 2*b*). The eventual final width of the pinch seal 23' can be determined by suitable shaping of the final pinch sealing jaws.

The lateral slits 12 permit formation and shaping of the external leads in accordance with any desired current supply connection. FIG. 2*c* illustrates a finished lamp 5'', in which the external current supply leads 6'' are carried out laterally at a right angle with respect to the longitudinal axis of the final pinch or press seal 23''. Thus, the final position of the external leads 6' or 6'' can be as desired; of course, after the pre-deformed portion 23 is finally made into the pinch or press seal 23', 23'', respectively, the position of the leads 6', 6'' within the glass of the pinch seal will be fixed, since the slit 12 will be closed around the portions of the connecting wires or leads 6', 6'', respectively, within the glass.

Various changes and modifications may be made within the scope of the inventive concept.

In a lamp of 35 W power rating, for example of the type HQI/T 35 W NDL, the following dimensions were used:

diameter of tubing 1: 10.5 mm, longitudinal dimension of pre-formed oval zone 3: 13 mm, current supply leads, molybdenum wires 6, diameter: 0.6 mm, molybdenum foils 9, thickness: 22 $\mu$m, length: 6 mm.

In prior art lamps, the inner spacing of current supply leads was: 4 mm.

In the lamp 5, FIG. 1*e*, of the present invention, the inner spacing of the current supply leads 6 was increased to: 8 mm.

Final diameter of pinch or press seal 3',

FIG. 1*e*: 12 mm. Diameter of tubing of lamp 5', 5'', FIGS. 2*b*, 2*c*: 10.5 mm.

Final maximum dimension of pinch seal 23', 23'' of the lamps, FIGS. 2*b*, 2*c*: 14 mm, 12 mm respectively.

All lamps were made with essentially identical power rating, except as otherwise noted. Auxiliary apparatus provided lamp igniting or starting pulses of $\geqq 6$ kV$_p$ to the respective external current supply leads 6.

We claim:

1. Method of making a single-ended metal halide high-pressure discharge lamp utilizing the steps of providing hard or quartz glass tubing (1) of circular cross-section to later form a discharge vessel for the lamp;

providing and connecting a pump tube to the tubing;

heating a portion of the glass tubing (1), spaced from the attachment of the pump tube, to a temperature sufficient to render the glass of the tubing (1) plastically deformable;

providing a subassembly of an electrode system, comprising external current supply leads (6, 6', 6''), sealing foils (9), and electrodes (7) secured to the sealing foils;

introducing the subassembly of the external current supply leads, sealing foils, and electrodes into glass tubing in the region of the glass tubing which has been heated to plastically deformable temperature;

forming a pinch seal (3') by moving pinch jaws from diametrically opposite sides of the tubing against the heated region of the tubing;

evacuating and filling the discharge vessel (4) defined between the connection to the pump tube and the thus-formed pinch seal, and tipping off the discharge vessel, and, in accordance with the invention, further comprising the steps of pre-deforming the heated, plastically deformable portion of the glass tubing to have, in an end view, an oval elongated shape, in which the oval has a large diameter greater than the diameter of the tubing;

then carrying out the step of introducing said subassembly through the oval-shaped portion of the glass tubing, after the heated region of the tubing has been pre-deformed;

and then carrying out the step of forming the pinch seal, including changing the dimension of elongated heated region of the glass to the desired dimension of the pinch seal.

2. The method of claim 1, further including the step of forming slits (12) at the narrow side surfaces (11) of the pre-deformed oval portion (23) of the tubing, prior to carrying out the step of introducing the electrode subassembly.

3. The method of claim 2, wherein the electrode subassembly comprises external connecting leads (6', 6'') extending laterally from said connecting foils (9) for a distance greater than the diameter of the tubing;

and the step of introducing the subassembly comprises placing the laterally extending portions of the connecting leads (6', 6'') into said slits.

4. The method of claim 2, wherein the step of pre-deforming the heated, plastically deformable portion of the glass tubing comprises moving pre-deforming jaws (13) against the heated, plastically deformable portion of the circular glass tubing until the heated end of said tubing assumes an oval shape.

5. The method of claim 1, wherein the step of pre-deforming the heated, plastically deformable portion of the glass tubing comprises moving pre-deforming jaws (13) against the heated, plastically deformable portion of the circular glass tubing until the heated end of said tubing assumes an oval shape.

6. High-pressure metal halide discharge lamp with improved electrode lead separation and high-voltage flash-over resistance made in accordance with the method claimed in claim 1, wherein the external current supply leads (6) are each formed with an end portion attached to and extending at a right angle to the respective sealing foil (9) said end portions and attachments to the respective sealing foils being located within said pinch seal (3').

7. The lamp of claim 6, wherein the external current supply leads (6) extend through the pinch seal parallel to each other and at right angles to an end portion of the pinch seal (3') remote from said discharge vessel (4'), the angled-off portions of the current supply leads having axially inwardly directed end zones, facing each other, to place the portions of the current supply leads leaving the end (10) of the pinch seal with maximum spacing between each other, and wherein said maximum spacing of the longitudinal axes of the current supply leads externally of the lamp is greater than the distance of the longitudinal axes of the sealing foils, but less than the width of the pinch seal (3').

8. The lamp of claim 6, wherein the external current supply leads (6') extend laterally from the pinch seal (23') and also include portions extending axially with respect to the lamp.

9. High-pressure metal halide discharge lamp with improved electrode lead separation and high-voltage flash-over resistance made in accordance with the method of claim 1, wherein the longitudinal axes of the external current supply leads (6, 6', 6''), in a region forming the attachment or connection to the respective sealing foils (9), form a right angle with respect to the major direction of the sealing foils, said sealing foils being located within the pinch seal (3', 23', 23'').

10. The lamp of claim 9, wherein the external current supply leads (6'') in a region outside of the pinch seal (23'') extend laterally outwardly from the pinch seal.

11. The lamp of claim 9, wherein the external current supply leads (6') in a region outside of the pinch seal (23') extend laterally outwardly for a short distance and then are angled to extend parallel to a major axis of the lamp.

* * * * *